US010527387B1

(12) United States Patent
Oliva Chavez et al.

(10) Patent No.: US 10,527,387 B1
(45) Date of Patent: Jan. 7, 2020

(54) METHOD AND APPARATUS FOR INSTALLING, REPOSITIONING, SWAPPING, OR REMOVING A FOREGRIP

(71) Applicants: Michael A. Oliva Chavez, San Antonio, TX (US); Bradley Arnold, Mason, OH (US)

(72) Inventors: Michael A. Oliva Chavez, San Antonio, TX (US); Bradley Arnold, Mason, OH (US)

(73) Assignee: Olive Arrow, LLC, San Antonio, TX (US)

( * ) Notice: Subject to any disclaimer, the term of this patent is extended or adjusted under 35 U.S.C. 154(b) by 0 days.

(21) Appl. No.: 15/916,024

(22) Filed: Mar. 8, 2018

Related U.S. Application Data

(60) Provisional application No. 62/485,533, filed on Apr. 14, 2017.

(51) Int. Cl.
*F41C 23/16* (2006.01)
*F41C 27/00* (2006.01)

(52) U.S. Cl.
CPC ..... *F41C 23/16* (2013.01); *F41C 27/00* (2013.01)

(58) Field of Classification Search
CPC ..... F41C 23/16; F41C 27/00
USPC ..... 42/71.01
See application file for complete search history.

(56) References Cited

U.S. PATENT DOCUMENTS 6,487,807 B1 * 12/2002 Kopman ..... F41A 23/12 42/72
6,698,127 B2 * 3/2004 Weber ..... F41A 9/65 42/49.01
7,191,557 B2 3/2007 Gablowski et al.
7,584,568 B1 * 9/2009 Brownlee ..... F41A 23/12 42/94
7,937,875 B1 * 5/2011 Berg ..... F41C 23/16 42/71.01
8,215,047 B2 * 7/2012 Ash, Jr. ..... F41C 23/16 42/71.01
8,245,428 B2 * 8/2012 Griffin ..... F41C 23/16 42/72
8,402,684 B1 * 3/2013 Beltz ..... F41A 23/10 42/72
8,839,544 B2 * 9/2014 Troy ..... F41C 23/16 42/72
9,285,075 B2 * 3/2016 Moody ..... F41A 23/08
9,383,163 B2 * 7/2016 Kincel ..... F41C 23/16
(Continued)

*Primary Examiner* — Michelle Clement
(74) *Attorney, Agent, or Firm* — Taboada Law Firm, PLLC; John M. Taboada

(57) ABSTRACT

A method and apparatus for installing, repositioning, and/or removing a foregrip are disclosed, including providing a foregrip comprising: a rail base mount; a grip assembly comprising: a grip body; one or more guide pins; a plunger; and a locking spring; and a separating spring disposed within the grip body and partially disposed within a portion of the rail base mount; wherein the grip assembly is rotatably coupled to the rail base mount in either an unlocked foregrip state or a locked foregrip state; wherein in the locked foregrip state, a portion of the plunger protrudes into a slot of the rail base mount to secure the foregrip to the sectional rail; and wherein in the unlocked foregrip state; the plunger is retracted from the slot to permit the installation, repositioning, or removal of the foregrip from the sectional rail. Other embodiments are described and claimed.

36 Claims, 7 Drawing Sheets

(56) References Cited

U.S. PATENT DOCUMENTS

| | | | | |
|---|---|---|---|---|
| 9,573,268 | B2 * | 2/2017 | Azhocar | B25G 1/06 |
| 9,709,356 | B1 * | 7/2017 | Anstett | F41C 23/16 |
| 9,718,182 | B2 * | 8/2017 | Azhocar | B25G 3/38 |
| 9,851,180 | B2 * | 12/2017 | Ley | F41G 11/003 |
| 2005/0241206 | A1 * | 11/2005 | Teetzel | F41A 23/08<br>42/72 |
| 2009/0313873 | A1 * | 12/2009 | Roth | F41C 23/16<br>42/72 |
| 2016/0349013 | A1 * | 12/2016 | Ley | F41G 11/003 |

* cited by examiner

METHOD AND APPARATUS FOR INSTALLING, REPOSITIONING, SWAPPING, OR REMOVING A FOREGRIP

I. CROSS REFERENCE TO RELATED APPLICATIONS

This application claims the benefit of the filing date of U.S. Provisional Patent Application Ser. No. 62/485,533, filed on Apr. 14, 2017, entitled "Quick adjusting/repositioning, modular foregrip," the entire disclosure of which is hereby incorporated by reference into the present disclosure.

II. BACKGROUND

The invention relates generally to firearms having one or more mounting rails such as a Picatinny rail. More particularly, the invention relates to an innovative modular foregrip for quick, one-handed installation, adjustment, swapping, or removal from the mounting rail and methods of using the same.

III. SUMMARY

In one respect, disclosed is a foregrip comprising: a rail base mount, wherein the rail base mount comprises: a head portion having a slot adapted to mate with a sectional rail; a cylindrical portion coupled to the head portion and having one or more guide channels cut into an exterior surface of the cylindrical portion; and a rail base mount central longitudinal bore through the head portion and the cylindrical portion; a grip assembly, wherein the grip assembly comprises: a grip body having a grip central longitudinal bore with three or more diameters; one or more guide pins attached to the grip body and partially protruding into the grip central longitudinal bore; a plunger positioned substantially within the grip central longitudinal bore and captured within the body by an internal grip body portion and a stop plate coupled within the grip central longitudinal bore; and a locking spring disposed between the plunger and the stop plate; and a separating spring disposed within the grip body and partially disposed within a portion of the cylindrical portion of the rail base mount central longitudinal bore; wherein the cylindrical portion of the rail base mount fits within the portion of the grip central longitudinal bore where the one or more guide pins are attached to the grip body; wherein the one or more guide channels are configured to accommodate the one or more guide pins; wherein the grip assembly is rotatably coupled to the rail base mount in either an unlocked foregrip state or a locked foregrip state; wherein in the locked foregrip state, a portion of the plunger protrudes into the slot to secure the foregrip to the sectional rail; and wherein in the unlocked foregrip state; the plunger is retracted from the slot to permit the installation, repositioning, or removal of the foregrip from the sectional rail.

In another respect, disclosed is a foregrip comprising: a rail base mount, wherein the rail base mount comprises: a head portion having a slot adapted to mate with a sectional rail; a cylindrical portion coupled to the head portion and having one or more guide pins attached to an exterior surface of the cylindrical portion; and a rail base mount central longitudinal bore through the head portion and the cylindrical portion; a grip assembly, wherein the grip assembly comprises: a grip body having a grip central longitudinal bore with three or more diameters; one or more guide channels cut into a portion of the grip central longitudinal bore; a plunger positioned substantially within the grip central longitudinal bore and captured within the grip body by an internal grip body portion and a stop plate coupled within the grip central longitudinal bore; and a locking spring disposed between the plunger and the stop plate; and a separating spring disposed within the grip body and partially disposed within a portion of the cylindrical portion of the rail base mount central longitudinal bore; wherein the cylindrical portion of the rail base mount fits within the portion of the grip central longitudinal bore where the one or more guide channels are cut into the portion of the grip central longitudinal bore; wherein the one or more guide channels are configured to accommodate the one or more guide pins; wherein the grip assembly is rotatably coupled to the rail base mount in either an unlocked foregrip state or a locked foregrip state; wherein in the locked foregrip state, a portion of the plunger protrudes into the slot to secure the foregrip to the sectional rail; and wherein in the unlocked foregrip state; the plunger is retracted from the slot to permit the installation, repositioning, or removal of the foregrip from the sectional rail.

In another respect, disclosed is a method for installing, repositioning, swapping, and/or removing a foregrip on a sectional rail, the method comprising: a) providing a foregrip comprising: a rail base mount, wherein the rail base mount comprises: a head portion having a slot adapted to mate with the sectional rail; a cylindrical portion coupled to the head portion and having one or more guide channels cut into an exterior surface of the cylindrical portion; and a rail base mount central longitudinal bore through the head portion and the cylindrical portion; a grip assembly, wherein the grip assembly comprises: a grip body having a grip central longitudinal bore with three or more diameters; one or more guide pins attached to the grip body and partially protruding into the grip central longitudinal bore; a plunger positioned substantially within the grip central longitudinal bore and captured within the body by an internal grip body portion and a stop plate coupled within the grip central longitudinal bore; and a locking spring disposed between the plunger and the stop plate; and a separating spring disposed within the grip body and partially disposed within a portion of the cylindrical portion of the rail base mount central longitudinal bore; wherein the cylindrical portion of the rail base mount fits within the portion of the grip central longitudinal bore where the one or more guide pins are attached to the grip body; wherein the one or more guide channels are configured to accommodate the one or more guide pins; wherein the grip assembly is rotatably coupled to the rail base mount in either an unlocked foregrip state or a locked foregrip state; wherein in the locked foregrip state, a portion of the plunger protrudes into the slot to secure the foregrip to the sectional rail; and wherein in the unlocked foregrip state; the plunger is retracted from the slot to permit the installation, repositioning, or removal of the foregrip from the sectional rail; b) with the foregrip in the unlocked foregrip state, sliding the foregrip onto the sectional rail; c) positioning the foregrip in a desired position along the sectional rail; d) placing the foregrip into the locked foregrip state by rotating the grip assembly in a first direction about a central longitudinal axis of the grip assembly; e) placing the foregrip into the unlocked foregrip state by rotating the grip assembly in a second direction, opposite the first direction, about the central longitudinal axis of the grip assembly; and f) repeating steps b), c), d), and e) as many times as desired to install, reposition, or remove the foregrip from the sectional rail.

In another respect, disclosed is a method for installing, repositioning, swapping, and/or removing a foregrip on a sectional rail, the method comprising: a) providing a foregrip comprising: a rail base mount, wherein the rail base mount comprises: a head portion having a slot adapted to mate with the sectional rail; a cylindrical portion coupled to the head portion and having one or more guide pins attached to an exterior surface of the cylindrical portion; and a rail base mount central longitudinal bore through the head portion and the cylindrical portion; a grip assembly, wherein the grip assembly comprises: a grip body having a grip central longitudinal bore with three or more diameters; one or more guide channels cut into a portion of the grip central longitudinal bore; a plunger positioned substantially within the grip central longitudinal bore and captured within the grip body by an internal grip body portion and a stop plate coupled within the grip central longitudinal bore; and a locking spring disposed between the plunger and the stop plate; and a separating spring disposed within the grip body and partially disposed within a portion of the cylindrical portion of the rail base mount central longitudinal bore; wherein the cylindrical portion of the rail base mount fits within the portion of the grip central longitudinal bore where the one or more guide channels are cut into the portion of the grip central longitudinal bore; wherein the one or more guide channels are configured to accommodate the one or more guide pins; wherein the grip assembly is rotatably coupled to the rail base mount in either an unlocked foregrip state or a locked foregrip state; wherein in the locked foregrip state, a portion of the plunger protrudes into the slot to secure the foregrip to the sectional rail; and wherein in the unlocked foregrip state; the plunger is retracted from the slot to permit the installation, repositioning, or removal of the foregrip from the sectional rail; b) with the foregrip in the unlocked foregrip state, sliding the foregrip onto the sectional rail; c) positioning the foregrip in a desired position along the sectional rail; d) placing the foregrip into the locked foregrip state by rotating the grip assembly in a first direction about a central longitudinal axis of the grip assembly; e) placing the foregrip into the unlocked foregrip state by pushing the grip assembly up towards the rail base mount and then rotating the grip assembly in a second direction, opposite the first direction, about the central longitudinal axis of the grip assembly; and f) repeating steps b), c), d), and e) as many times as desired to install, reposition, or remove the foregrip from the sectional rail.

In yet another respect, disclosed is a firearm comprising: a firearm body; one or more sectional rails coupled to the firearm body; and a foregrip coupled to one of the one or more sectional rails, the foregrip comprising: a rail base mount, wherein the rail base mount comprises: a head portion having a slot adapted to mate with a sectional rail; a cylindrical portion coupled to the head portion and having one or more guide channels cut into an exterior surface of the cylindrical portion; and a rail base mount central longitudinal bore through the head portion and the cylindrical portion; a grip assembly, wherein the grip assembly comprises: a grip body having a grip central longitudinal bore with three or more diameters; one or more guide pins attached to the grip body and partially protruding into the grip central longitudinal bore; a plunger positioned substantially within the grip central longitudinal bore and captured within the body by an internal grip body portion and a stop plate coupled within the grip central longitudinal bore; and a locking spring disposed between the plunger and the stop plate; and a separating spring disposed within the grip body and partially disposed within a portion of the cylindrical portion of the rail base mount central longitudinal bore; wherein the cylindrical portion of the rail base mount fits within the portion of the grip central longitudinal bore where the one or more guide pins are attached to the grip body; wherein the one or more guide channels are configured to accommodate the one or more guide pins; wherein the grip assembly is rotatably coupled to the rail base mount in either an unlocked foregrip state or a locked foregrip state; wherein in the locked foregrip state, a portion of the plunger protrudes into the slot to secure the foregrip to the sectional rail; and wherein in the unlocked foregrip state; the plunger is retracted from the slot to permit the installation, repositioning, or removal of the foregrip from the sectional rail.

In yet another respect, disclosed is a firearm comprising: a firearm body; one or more sectional rails coupled to the firearm body; and a foregrip coupled to one of the one or more sectional rails, the foregrip comprising: a rail base mount, wherein the rail base mount comprises: a head portion having a slot adapted to mate with a sectional rail; a cylindrical portion coupled to the head portion and having one or more guide pins attached to an exterior surface of the cylindrical portion; and a rail base mount central longitudinal bore through the head portion and the cylindrical portion; a grip assembly, wherein the grip assembly comprises: a grip body having a grip central longitudinal bore with three or more diameters; one or more guide channels cut into a portion of the grip central longitudinal bore; a plunger positioned substantially within the grip central longitudinal bore and captured within the grip body by an internal grip body portion and a stop plate coupled within the grip central longitudinal bore; and a locking spring disposed between the plunger and the stop plate; and a separating spring disposed within the grip body and partially disposed within a portion of the cylindrical portion of the rail base mount central longitudinal bore; wherein the cylindrical portion of the rail base mount fits within the portion of the grip central longitudinal bore where the one or more guide channels are cut into the portion of the grip central longitudinal bore; wherein the one or more guide channels are configured to accommodate the one or more guide pins; wherein the grip assembly is rotatably coupled to the rail base mount in either an unlocked foregrip state or a locked foregrip state; wherein in the locked foregrip state, a portion of the plunger protrudes into the slot to secure the foregrip to the sectional rail; and wherein in the unlocked foregrip state; the plunger is retracted from the slot to permit the installation, repositioning, or removal of the foregrip from the sectional rail.

Numerous additional embodiments are also possible.

IV. BRIEF DESCRIPTION OF THE DRAWINGS

Other objects and advantages of the invention may become apparent upon reading the detailed description and upon reference to the accompanying drawings.

Figure 1:
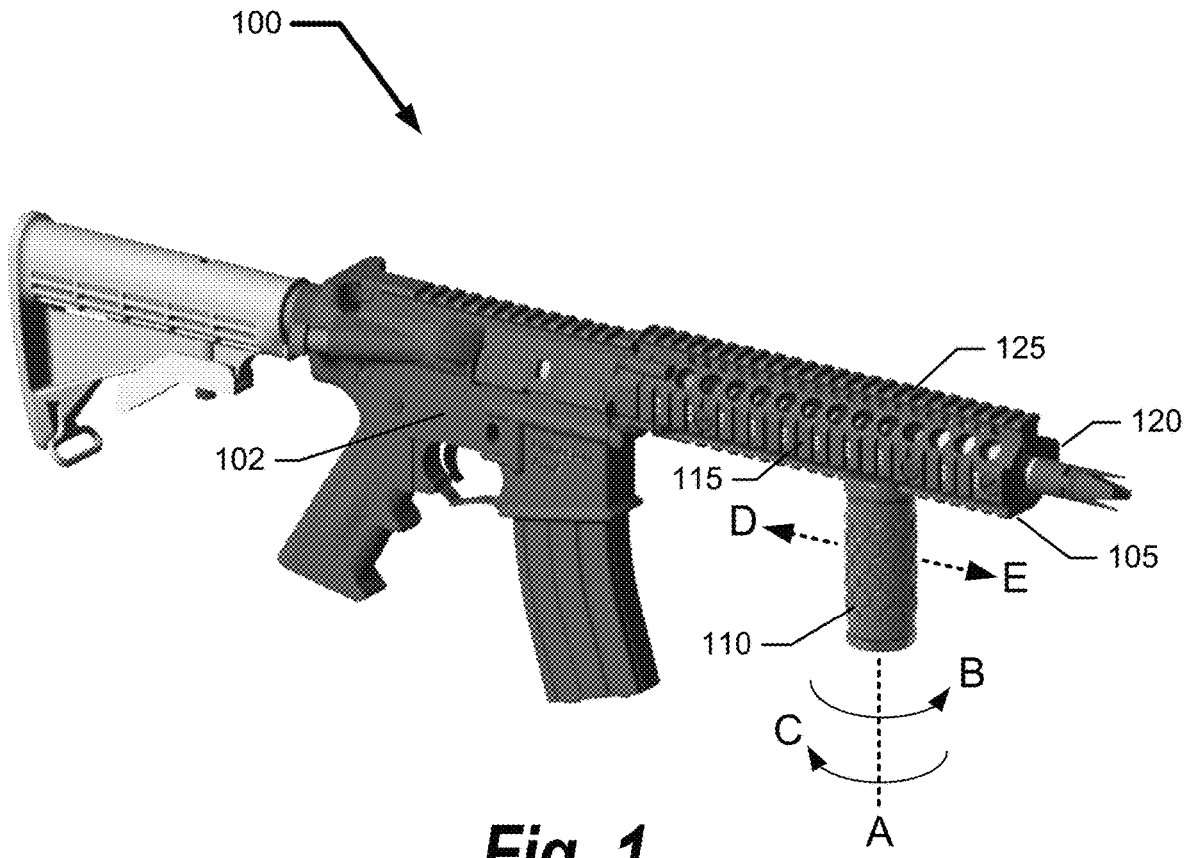
FIG. 1 is an isometric view of a firearm with a foregrip mounted on the underside of the firearm, in accordance with some embodiments.

While the invention is subject to various modifications and alternative forms, specific embodiments thereof are shown by way of example in the drawings and the accompanying detailed description. It should be understood, however, that the drawings and detailed description are not intended to limit the invention to the particular embodiments. This disclosure is instead intended to cover all modifications, equivalents, and alternatives falling within the scope of the present invention as defined by the appended claims.

V. DETAILED DESCRIPTION

One or more embodiments of the invention are described below. It should be noted that these and any other embodiments are exemplary and are intended to be illustrative of the invention rather than limiting. While the invention is widely applicable to different types of systems, it is impossible to include all of the possible embodiments and contexts of the invention in this disclosure. Upon reading this disclosure, many alternative embodiments of the present invention will be apparent to persons of ordinary skill in the art.

Firearms may be equipped with longitudinal rails, such as Picatinny rails, for attaching a variety of accessories. The rails may be found on many different positions of the firearm. One of the accessories that may be mounted to the rails is a foregrip. The foregrip provides an additional gripping position for the firearm to facilitate the handling and control of the firearm. In some circumstances, there may be a need to readjust the position of the foregrip. Unfortunately, existing foregrips require screws and/or levers to remove or adjust the position of the foregrip and are not designed for quick, singled handed operation. Additionally, situations may arise where the shape and/or style of the grip portion of the foregrip is desired to be changed without having to remove the foregrip from the firearm. Existing foregrips are also not capable of merely swapping the grip style/shape of the foregrip without having to replace the entire foregrip.

The embodiment described herein solves these problems and others by proposing a new modular foregrip for quick, one-handed installation, adjustment, swapping, or removal from the mounting rail and methods of using the same. Throughout the patent, the positions such as "bottom," "top," "left," "right," "up," "down" and the like are referenced to the firearm held horizontally in a normal firing position.

FIG. 1 is an isometric view of a firearm with a foregrip mounted on the underside of the firearm, in accordance with some embodiments.

In some embodiments, a firearm 100 comprises a firearm body 102, a sectional rail 105 mounted to the bottom of the front end of the firearm body 102 and a foregrip 110 mounted onto the sectional rail 105. The foregrip is capable of being installed, adjusted, swapped, or removed from the bottom sectional rail quickly and with only one hand. The foregrip may also be attached onto either the right side sectional rail 115, the left side sectional rail 120, or even the top section rail 125. To install the foregrip, the foregrip, in an unlocked state, is slid and positioned onto a sectional rail. Once positioned, the grip portion of the foregrip is rotated about the central axis A of the foregrip in a clockwise direction as viewed from the bottom of the firearm, illustrated by arrow B, to advance a spring-loaded plunger up towards the firearm which results in a locking force being applied onto the groove of the sectional rail. If the foregrip needs to be repositioned, the grip portion of the foregrip is pushed up towards the sectional rail and rotated about the central axis A of the foregrip in a counterclockwise direction as viewed from the bottom of the firearm, illustrated by arrow C, to retract the spring-loaded plunger away from the firearm. When the spring-loaded plunger is retracted, the foregrip may then be slid toward the user as illustrated by arrow D or away from the user as illustrated by arrow E. To remove the foregrip, the foregrip is slid in the direction of arrow E until it has been separated from the section rail. The user may also desire to change or swap the grip of the foregrip. To accomplish this, the grip portion of the foregrip is pushed up toward the sectional rail and rotated in the direction of arrow C followed by pulling the grip portion of the foregrip down away from the sectional rail to separate the grip portion of the firearm from the rail base mount. Once separated, another grip may be attached to the rail base mount by pushing the grip up toward the sectional rail until it reaches a stopping point and then rotating the grip in the direction of arrow B. The internal workings of the foregrip will be illustrated in FIG. 2, FIG. 3, FIG. 4, and FIG. 5. In alternate embodiments, the rotation direction may be swapped such that a rotation in the direction of arrow B would retract the spring-loaded plunger and a rotation in the direction of arrow C would advance the spring-loaded plunger.

Figure 2:
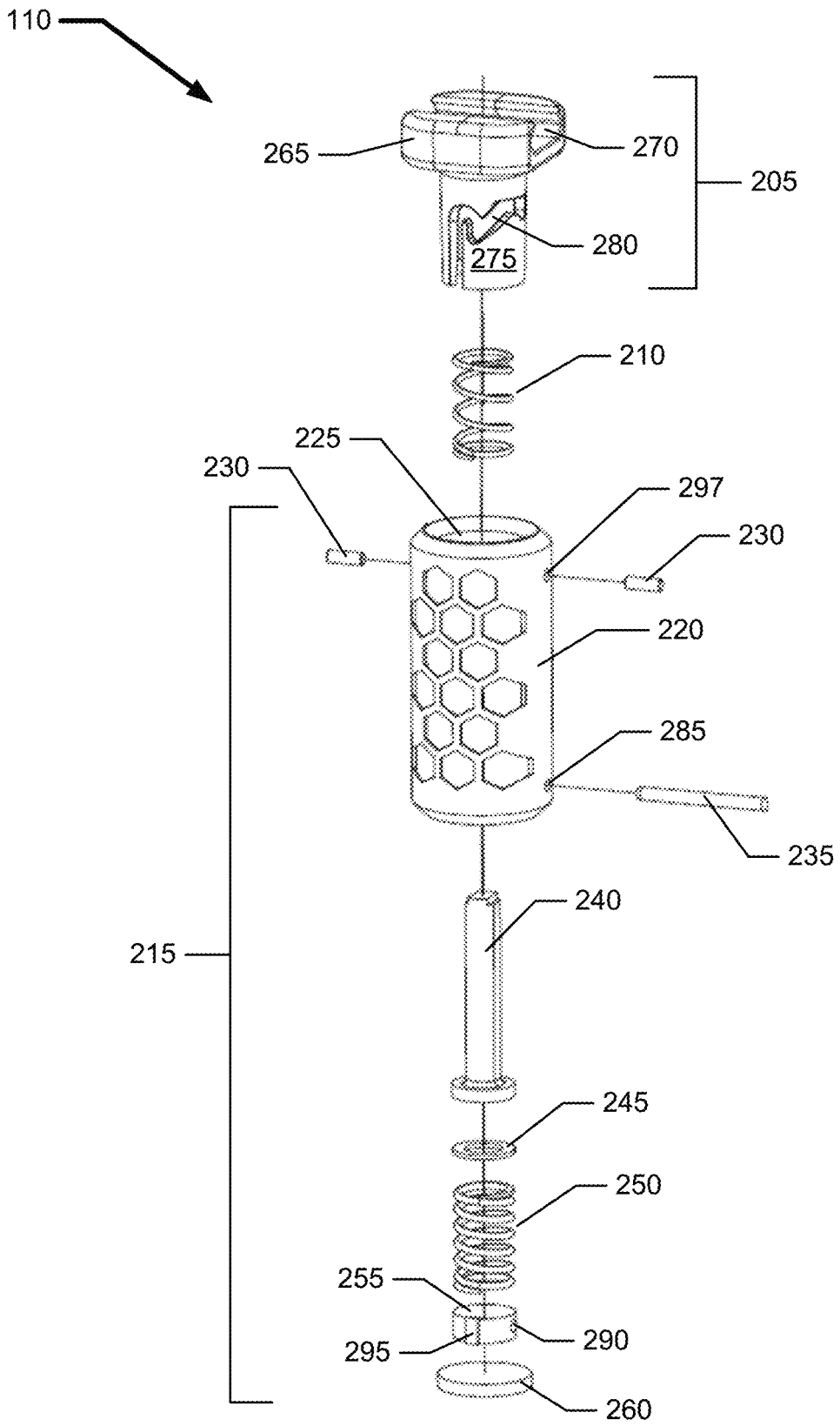
FIG. 2 is an exploded view of the foregrip, in accordance with some embodiments.

FIG. 2 is an exploded view of the foregrip, in accordance with some embodiments.

In some embodiments, the foregrip 110 comprises a rail base mount 205, a separating spring 210, and a grip assembly 215. The grip assembly comprises a grip body 220 having a grip central longitudinal bore 225, one or more guide pins 230, a retaining pin 235, a plunger 240, a thrust washer 245, a locking spring 250, a stop plate 255, and a bottom cap 260 which conceals the thrust washer, the locking spring, the stop plate, and a portion of the plunger within the grip assembly. The rail base mount 205 comprises a head portion 265 having a slot 270 shaped to mate with a sectional rail, a cylindrical portion 275 coupled to the head portion and having one or more guide channels 280 cut into the exterior surface of the cylindrical portion, and a rail base mount central longitudinal bore (shown in FIG. 6). The rail base mount is configured to accommodate a portion of the separating spring 210 within the cylindrical portion and a portion of the plunger 240 of the grip assembly within the cylindrical portion and the head portion. The rail base mount central longitudinal bore has two or more diameters such that a portion of the plunger 240 penetrates into the slot, but the separating spring 210 does not penetrate into the slot. The grip central longitudinal bore 225 has three or more diameters such that the cylindrical portion 275 of the rail base mount may be accommodated into the upper portion of the grip assembly and a portion of the plunger 240, the thrust washer 245, and the locking spring 250 will be captured between the stop plate 255 and an internal grip body portion (illustrated in FIG. 5). The internal grip body portion has a diameter and/or shape such that the head of the plunger (portion closest to the bottom cap) cannot pass through it. The plunger 240 is captured within the grip assembly by the stop plate 255 which is secured within the grip body 220 by the retaining pin 235 passing through a grip body aperture 285 and a stop plate bore 290. The stop plate may also have an index portion 295 which facilities in the assembly of the grip assembly by aligning the stop plate bore with the grip body aperture when the stop plate is inserted into the grip body. To accommodate the index portion, the grip body has a corresponding index notch within the interior portion of the grip body. The one or more guide pins 230 are positioned in the upper portion of the grip assembly and are configured to fit and travel within the one or more guide channels 280. The one or more guide pins may be inserted through corresponding apertures 297 in the grip body as illustrated in FIG. 2 or alternatively inserted into blind holes from the interior of the grip body.

In an alternate embodiment, the positions of the one or more guide pins 230 and the one or more guide channels 280 are swapped such the one or more guide pins are part of the rail base mount 205 and the one or more guide channels are cut into the interior surface of the upper portion of the grip body 220. In this embodiment, the foregrip would still function the same in that the grip body would be rotated relative to the rail base mount in order to swap the grip body or to install, reposition, or remove the foregrip.

In an alternate embodiment, the foregrip 110 can be arranged so that the separating spring may be integrated into either the rail base mount or the grip assembly. Integrating the separating spring helps to ensure that it does not get lost during the swapping of the grip assembly. If the separating spring is not integrated, when swapping the grip body, once the original grip body has been removed, the separating spring would have to be positioned within the new grip body before the new grip body is coupled to the original rail base mount.

In some embodiments, the rail base mount 205, the grip body 220, the plunger 240, the stop plate 255, and bottom cap 260 are each formed of a monolithic piece of rigid material, such as (but not limited to) metal, plastic, polycarbonate, compounds thereof and the like, all of which are well known in the art for their suitability for firearm accessory material. Alternatively, the rail base mount 205, the grip body 220, the plunger 240, the stop plate 255, and bottom cap 260 may each be formed from one or more pieces of rigid material and then joined together via conventional means. Such forming and/or joining may be accomplished through any methods known in the art for producing metal and plastic materials. Accordingly, the methods of making the rail base mount 205, the grip body 220, the plunger 240, the stop plate 255, and bottom cap 260 are not further discussed herein.

In some embodiments, the rail base mount 205, the grip body 220, the plunger 240, and the stop plate 255 are formed of a monolithic piece of rigid material, such as (but not limited to) metal, plastic, polycarbonate, compounds thereof and the like, all of which are well known in the art for their suitability for firearm accessory material.

In some embodiments, the one or more guide pins 230, the retaining pin 235, the separating spring 210, the locking spring 250, and the thrust washer 245 are formed of a monolithic piece of rigid material, such as (but not limited to) metal, plastic, polycarbonate, compounds thereof and the like, all of which are well known in the art for their suitability as pins, springs, and washers, respectively.

Figure 3:
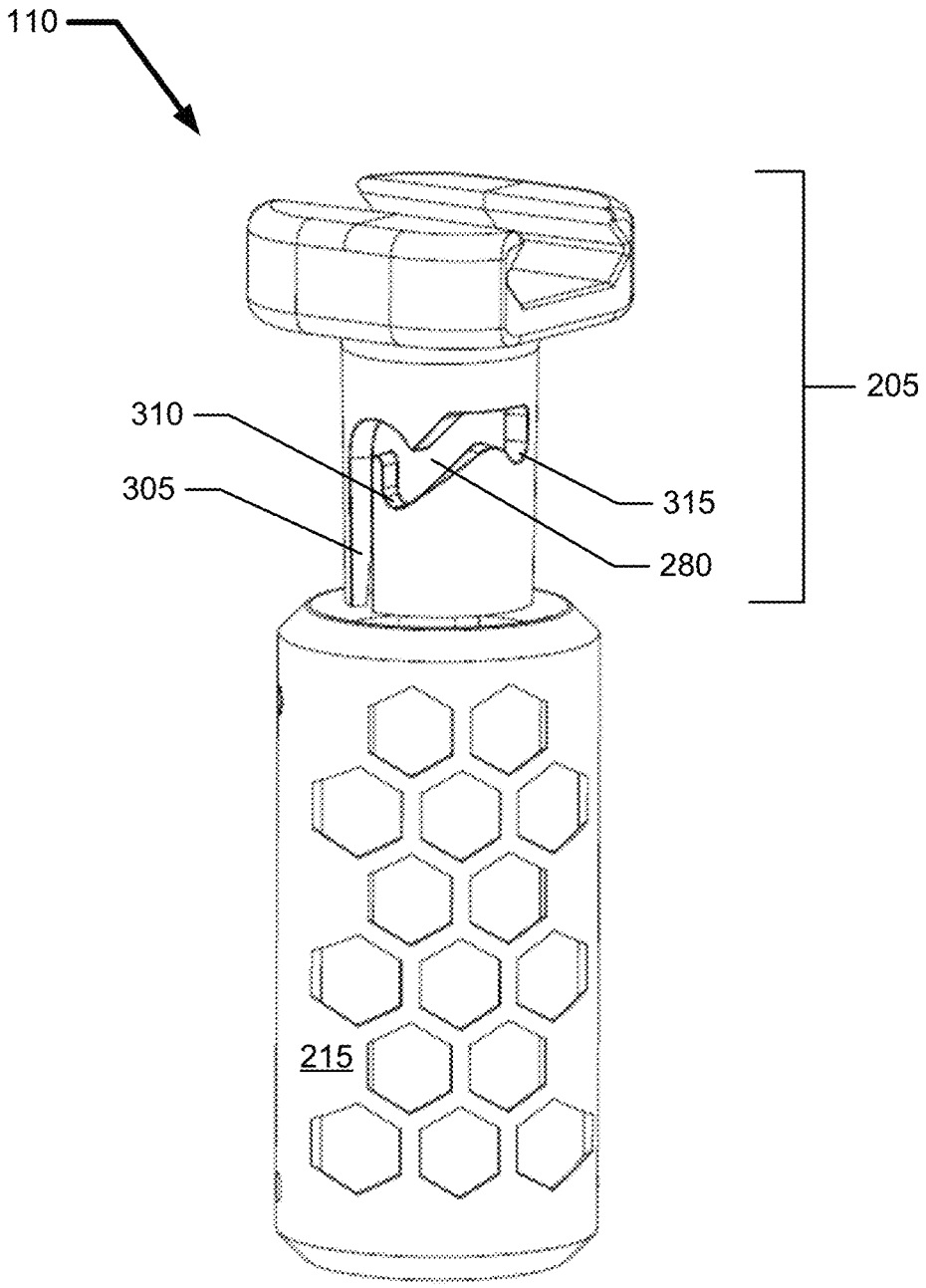
FIG. 3 is an isometric view of the foregrip partially disassembled, in accordance with some embodiments.

FIG. 3 is an isometric view of the foregrip partially disassembled, in accordance with some embodiments.

Figure 4A:
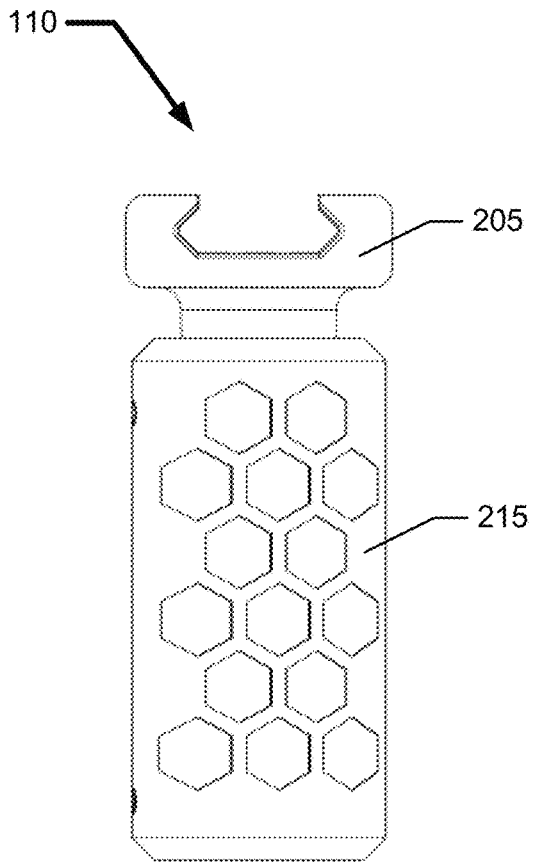
FIGS. 4A and 4B are side elevation views of the foregrip in an unlocked state and locked state, respectively, in accordance with some embodiments.
Figure 4B:
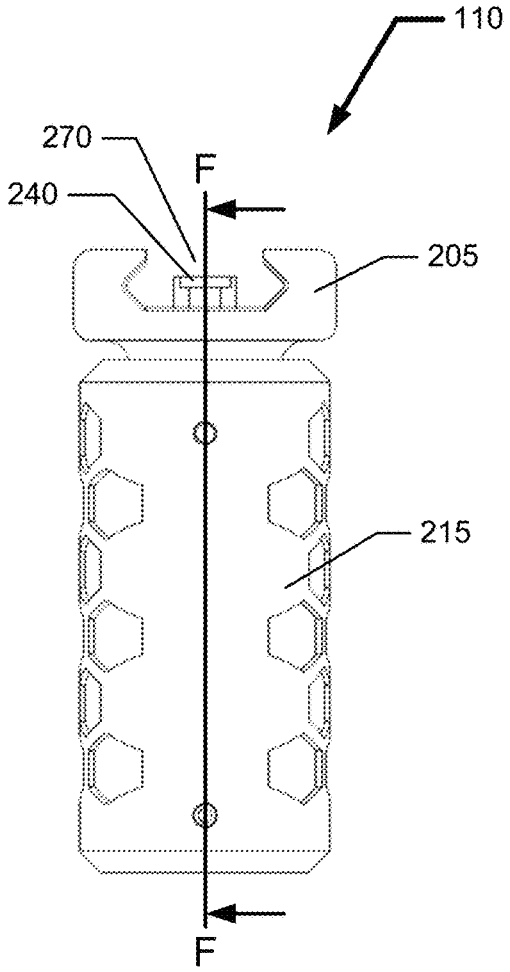

FIGS. 4A and 4B are side elevation views of the foregrip in an unlocked state and locked state, respectively, in accordance with some embodiments.

When the grip assembly 215 and rail base mount 205 of the foregrip 110 are brought together, the one or more guide pins are guided by an entry portion 305 of the one or more guide channels 280 and the separating spring is compressed. Once the grip assembly and rail base mount can no longer be brought together, the grip assembly may be rotated in the direction illustrated by arrow B of FIG. 1. After the rotation, the grip assembly may be released and the separating spring applies a restorative force to move the grip assembly and the rail base mount in opposite directions along their central axes, resulting in the one or more guide pins being captured within one or more unlocked state detents 310 of the one or more guide channels 280. In this unlocked state, shown in FIG. 4A, the foregrip may be slid onto a sectional rail as shown in FIG. 1. After the foregrip has been slid onto the sectional rail and is in the user's desired position, the foregrip may be secured by rotating the grip assembly in the direction illustrated by arrow B of FIG. 1 until the grip assembly can no longer be rotated. The grip assembly is then released and the separating spring applies a restorative force to move the grip assembly away from the rail base mount to capture the one or more guide pins within one or more locked state detents 315 of the one or more guide channels. The locked state detents 315 do not permit the rotation of the grip body relative to the rail base mount since the one or more guide pins are being held in the wells of the locked state detents. Thus, in order to place the foregrip back into the unlocked state, a slight push of the grip body toward the rail base mount would be required to free the one or more guide pins out of the wells of the locked state detents. In the locked state, shown in FIG. 4B, a portion of the plunger 240 penetrates into the slot 270 of the foregrip and into a groove of the sectional rail resulting in a locking force being applied between foregrip and the sectional rail. In a Picatinny rail, the width and depth of the groove of the sectional rail have dimensions of 0.206 inches and 0.118 inches, respectively, and a portion of the plunger is configured to fit within the groove of the Picatinny rail. In some embodiments, the foregrip 110 has an overall height of about 3.5 inches in the locked state and an overall height of about 3.675 inches in the unlocked state.

In the embodiment illustrated in FIG. 3, rotating the grip assembly in the direction of arrow B as illustrated in FIG. 1 would result in placing the foregrip in a locked state. Conversely, pushing the grip assembly up towards the rail base mount and rotating the grip assembly in the direction of arrow C as illustrated in FIG. 1 would result in placing the foregrip in an unlocked state.

In an alternative embodiment, the one or more guide channels may be configured such that rotating the grip assembly in the direction of arrow B as illustrated in FIG. 1 would result in placing the foregrip in an unlocked state and rotating the grip assembly in the direction of arrow C as illustrated in FIG. 1 would result in placing the foregrip in a locked state.

Figure 5:
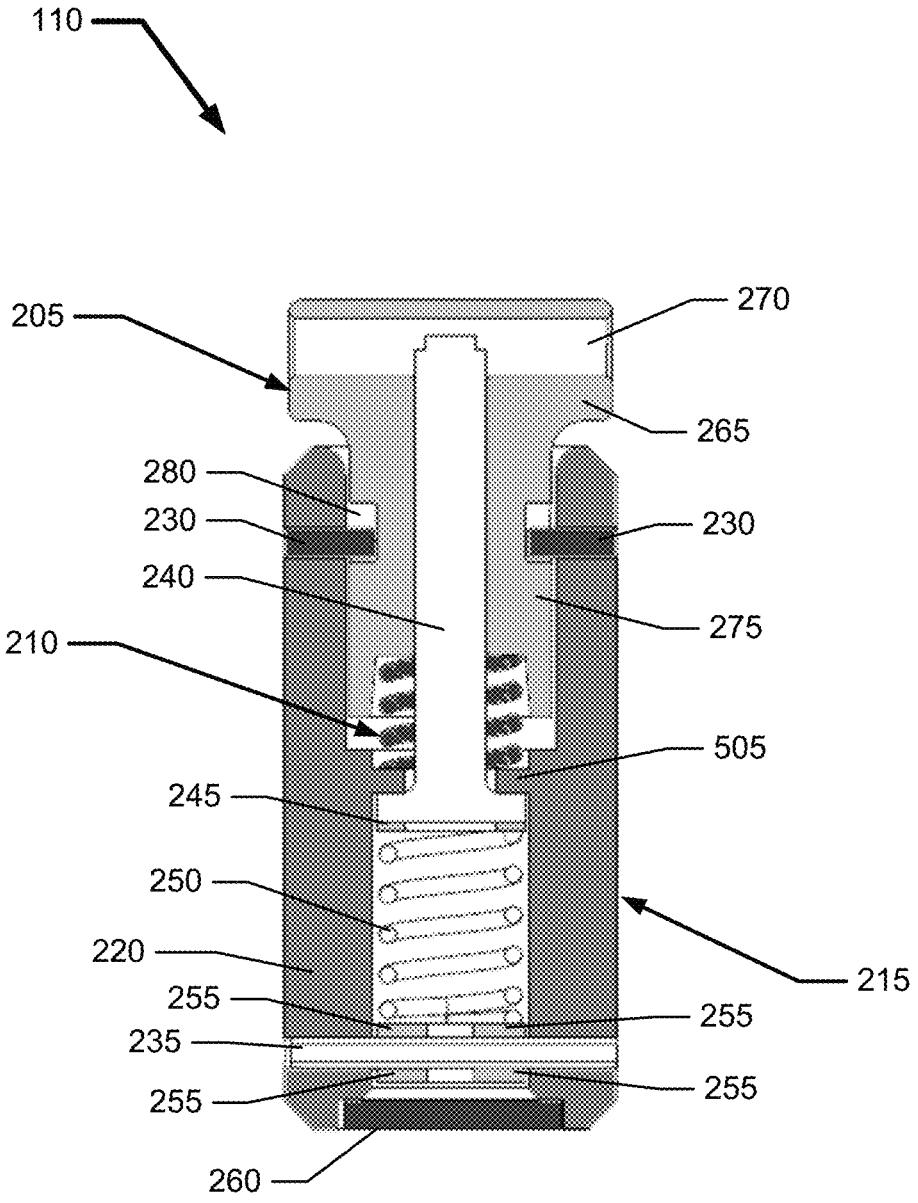
FIG. 5 is a cross-sectional view of the foregrip taken along line F-F of FIG. 4B, in accordance with some embodiments.

FIG. 5 is a cross-sectional view of the foregrip taken along line F-F of FIG. 4B, in accordance with some embodiments.

In some embodiments, the foregrip 110 comprises a rail base mount 205, a separating spring 210, and a grip assembly 215. The grip assembly comprises a grip body 220 having a grip central longitudinal bore, one or more guide pins 230, a retaining pin 235, a plunger 240, a thrust washer 245, a locking spring 250, a stop plate 255, and a bottom cap 260 which conceals the thrust washer, the locking spring, the stop plate, and a portion of the plunger within the grip assembly. The rail base mount 205 comprises a head portion 265 having a slot 270 shaped to attach/mate to a sectional rail, a cylindrical portion 275 coupled to the head portion and having one or more guide channels 280 cut into the exterior surface of the cylindrical portion, and a rail base mount central longitudinal bore configured to accommodate a portion of the separating spring 210 and a portion of the plunger 240 of the grip assembly. The rail base mount central longitudinal bore has two or more diameters such that a portion of the plunger 240 penetrates into the slot 270, but the separating spring 210 does not penetrate into the slot. The grip central longitudinal bore has three or more diameters such that the cylindrical portion 275 of the rail base mount may be accommodated into the upper portion of the grip assembly and the plunger 240, the thrust washer 245, and the locking spring 250 will be captured between the stop plate 255 and an internal grip body portion 505. The internal grip body portion 505 has a diameter and/or shape such that the larger shaped head of the plunger cannot pass through it. The stop plate 255 is secured within the grip body by the retaining pin 235 passing through a grip body aperture and a stop plate bore. The one or more guide pins 230 are positioned in the upper portion of the grip assembly and are configured to fit and travel within the one or more guide channels 280.

In an alternate embodiment, the positions of the one or more guide pins 230 and the one or more guide channels 280 are swapped such the one or more guide pins are part of the rail base mount 205 and the one or more guide channels are cut into the interior surface of the upper portion of the grip body 220. In this embodiment, the foregrip would still function the same in that the grip body would be rotated relative to the rail base mount in order to swap the grip body or to install, reposition, or remove the foregrip.

Figure 6:
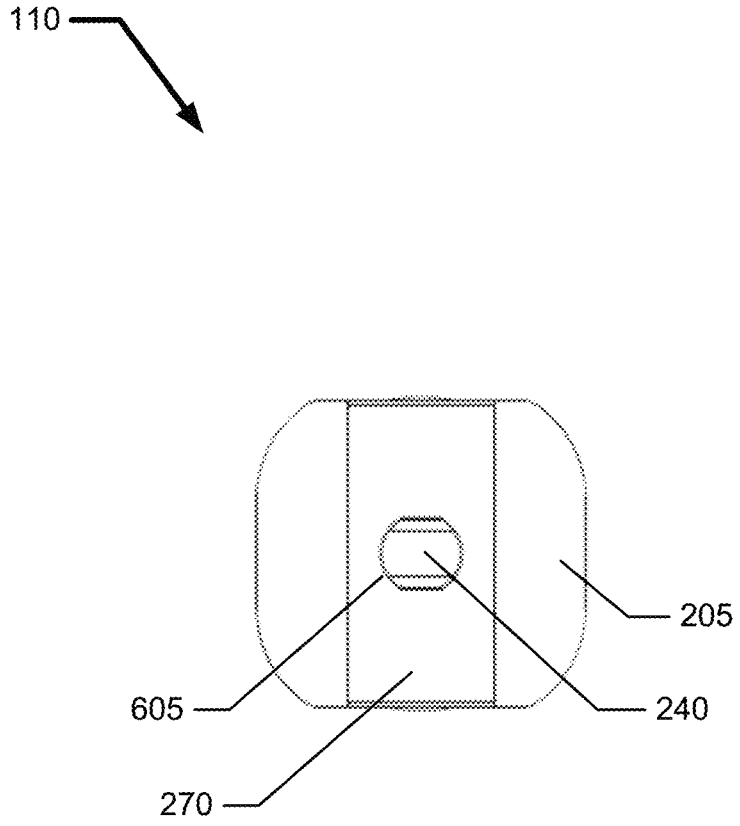
FIG. 6 is a top view of the foregrip, in accordance with some embodiments.

FIG. 6 is a top view of the foregrip, in accordance with some embodiments.

In some embodiments, the foregrip 110 comprises a rail base mount 205, a separating spring, and a grip assembly, and has an overall width of about 1.47 inches. As viewed from the top, the plunger 240 is visible through the rail base mount central longitudinal bore 605. The rail base mount central longitudinal bore is centered within the slot 270.

In some embodiments, the foregrip illustrated and described in FIG. 1, FIG. 2, FIG. 3, FIG. 4A, FIG. 4B, FIG. 5, and FIG. 6 may be used in other areas such as sports, cameras, and laboratories such as with airsoft guns, camera mounts and accessories, tools, laboratory mounts, and the like where a quick release, single handed mounting to a supporting structure is desired.

Figure 7:
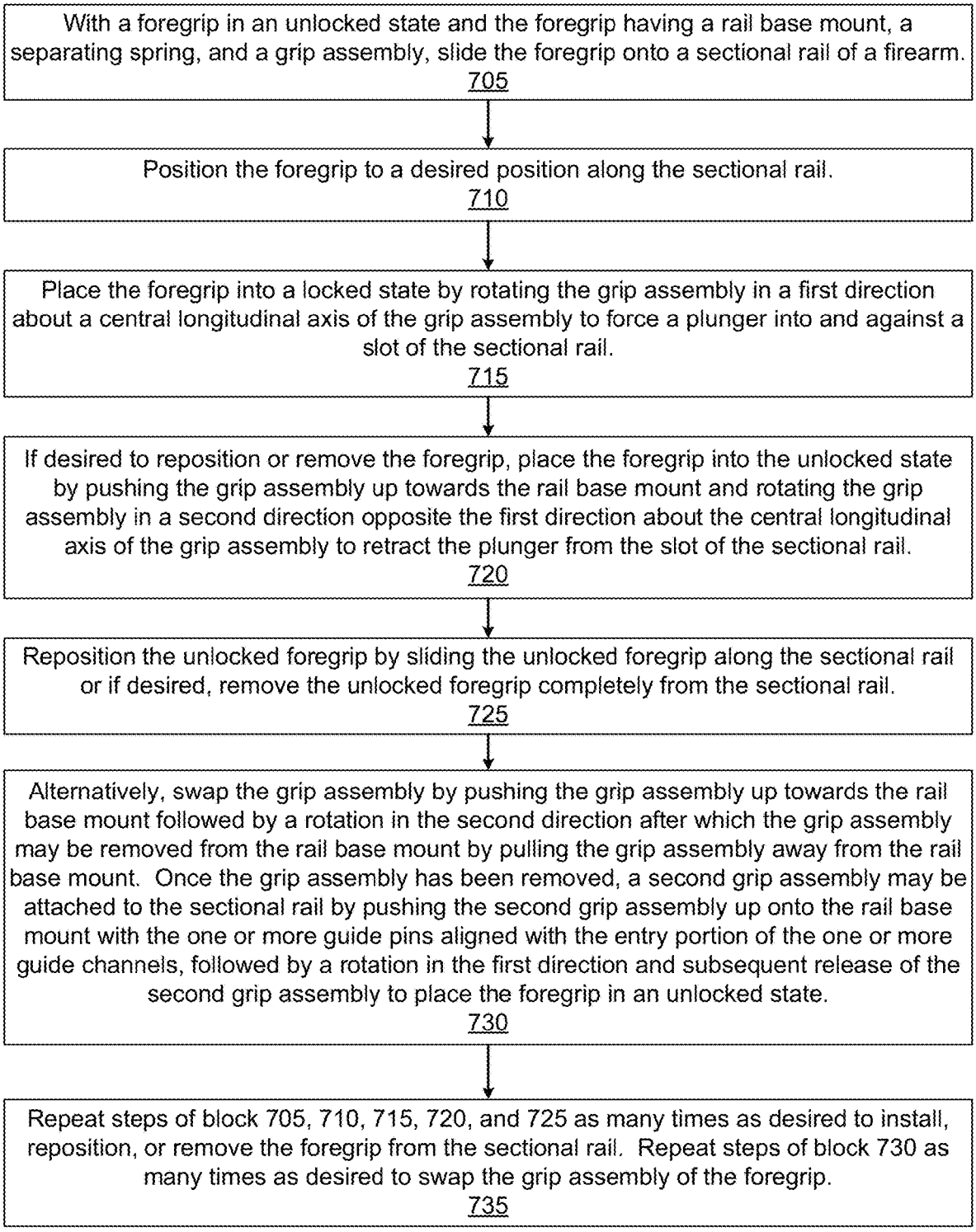
FIG. 7 is a flowchart illustrating a method for installing, adjusting, swapping, or removing a foregrip from a firearm using the foregrip illustrated in FIGS. 1 through 6, in accordance with some embodiments.

FIG. 7 is a flowchart illustrating a method for installing, adjusting, swapping, or removing a foregrip from a firearm using the foregrip illustrated in FIGS. 1 through 6, in accordance with some embodiments.

According to one embodiment of the present invention, the method begins at block 705, where, with a foregrip, in an unlocked state, separated from a firearm and the foregrip having a rail base mount, a separating spring, and a grip assembly, the foregrip is slid onto a sectional rail of a firearm. At block 710, the foregrip is positioned to a desired position along the sectional rail. Next, at block 715, the foregrip is placed into a locked state by rotating the grip assembly in a first direction about a central longitudinal axis of the grip assembly to force a plunger into and against a groove of the sectional rail. At block 720, if it is desired to reposition or remove the foregrip, the foregrip is placed into the unlocked state by pushing the grip assembly up towards the rail base mount and then rotating the grip assembly in a second direction opposite the first direction about the central longitudinal axis of the grip assembly to retract the plunger from the groove of the sectional rail. At block 725, the unlocked foregrip may now be repositioned by sliding the unlocked foregrip along the sectional rail or if desired, removed completely from the sectional rail. Alternatively, at block 730, the grip assembly may be swapped by pushing the grip assembly up towards the rail base mount followed by a rotation in the second direction after which the grip assembly may be removed from the rail base mount by pulling the grip assembly away from the rail base mount. Once the grip assembly has been removed, a second grip assembly may be attached to the sectional rail by pushing the second grip assembly up onto the rail base mount with the one or more guide pins aligned with the entry portion of the one or more guide channels, followed by a rotation in the first direction and subsequent release of the second grip assembly to place the foregrip in an unlocked state. Lastly, at block 735, the steps described in block 705, block 710, block 715, block 720, and block 725 may be repeated as many times as desired to install, reposition, or remove the foregrip from the sectional rail. Additionally, the steps described in block 730 may be repeated as many times as desired to swap the grip assembly of the foregrip.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The benefits and advantages that may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims.

The invention claimed is:

1. A foregrip comprising:

a rail base mount, wherein the rail base mount comprises:

a head portion having a slot adapted to mate with a sectional rail;

a cylindrical portion coupled to the head portion and having one or more guide channels cut into an exterior surface of the cylindrical portion; and a rail base mount central longitudinal bore through the head portion and the cylindrical portion;

a grip assembly, wherein the grip assembly comprises:

a grip body having a grip central longitudinal bore with three or more diameters;

one or more guide pins attached to the grip body and partially protruding into the grip central longitudinal bore;

a plunger positioned substantially within the grip central longitudinal bore and captured within the grip body by an internal grip body portion and a stop plate coupled within the grip central longitudinal bore; and a locking spring disposed between the plunger and the stop plate; and a separating spring disposed within the grip body and partially disposed within a portion of the cylindrical portion of the rail base mount central longitudinal bore;

wherein the cylindrical portion of the rail base mount fits within the portion of the grip central longitudinal bore where the one or more guide pins are attached to the grip body;

wherein the one or more guide channels are configured to accommodate the one or more guide pins;

wherein the grip assembly is rotatably coupled to the rail base mount in either an unlocked foregrip state or a locked foregrip state;

wherein in the locked foregrip state, a portion of the plunger protrudes into the slot to secure the foregrip to the sectional rail; and wherein in the unlocked foregrip state; the plunger is retracted from the slot to permit the installation, repositioning, or removal of the foregrip from the sectional rail.

2. The foregrip of claim 1, further comprising a thrust washer disposed between the locking spring and the plunger.

3. The foregrip of claim 1, further comprising a bottom cap coupled to the grip body and configured to conceal the stop plate, the locking spring, and a portion of the plunger within the grip body.

4. The foregrip of claim 1, wherein the stop plate is coupled within the grip central longitudinal bore by a retaining pin passing through an aperture of the grip body and a bore through the stop plate.

5. The foregrip of claim 4, wherein the grip body comprises an index notch within a portion of the grip central longitudinal bore and wherein the stop plate comprises an index portion configured to mate with the index notch to align the aperture of the grip body and the bore through the stop plate.

6. The foregrip of claim 1, wherein the grip assembly is configured to be swapped out from the rail base mount by a second grip assembly.

7. A method for installing, repositioning, swapping, and/or removing a foregrip on a sectional rail, the method comprising:

a) providing a foregrip comprising:

a rail base mount, wherein the rail base mount comprises:

a head portion having a slot adapted to mate with the sectional rail;

a cylindrical portion coupled to the head portion and having one or more guide channels cut into an exterior surface of the cylindrical portion; and a rail base mount central longitudinal bore through the head portion and the cylindrical portion;

a grip assembly, wherein the grip assembly comprises:

a grip body having a grip central longitudinal bore with three or more diameters;

one or more guide pins attached to the grip body and partially protruding into the grip central longitudinal bore;

a plunger positioned substantially within the grip central longitudinal bore and captured within the grip body by an internal grip body portion and a stop plate coupled within the grip central longitudinal bore; and a locking spring disposed between the plunger and the stop plate; and a separating spring disposed within the grip body and partially disposed within a portion of the cylindrical portion of the rail base mount central longitudinal bore;

wherein the cylindrical portion of the rail base mount fits within the portion of the grip central longitudinal bore where the one or more guide pins are attached to the grip body;

wherein the one or more guide channels are configured to accommodate the one or more guide pins;

wherein the grip assembly is rotatably coupled to the rail base mount in either an unlocked foregrip state or a locked foregrip state;

wherein in the locked foregrip state, a portion of the plunger protrudes into the slot to secure the foregrip to the sectional rail; and wherein in the unlocked foregrip state; the plunger is retracted from the slot to permit the installation, repositioning, or removal of the foregrip from the sectional rail;

b) with the foregrip in the unlocked foregrip state, sliding the foregrip onto the sectional rail;

c) positioning the foregrip in a desired position along the sectional rail;

d) placing the foregrip into the locked foregrip state by rotating the grip assembly in a first direction about a central longitudinal axis of the grip assembly;

e) placing the foregrip into the unlocked foregrip state by pushing the grip assembly up towards the rail base mount and then rotating the grip assembly in a second direction, opposite the first direction, about the central longitudinal axis of the grip assembly; and f) repeating steps b), c), d), and e) as many times as desired to install, reposition, or remove the foregrip from the sectional rail.

8. The method of claim 7, further comprising:

g) with the foregrip mounted to the sectional rail and in the unlocked foregrip state, swapping the grip assembly by pushing the grip assembly up towards the rail base mount followed by rotating the grip assembly in the second direction and subsequent releasing and separation of the grip assembly from the rail base mount;

h) swapping a second grip assembly onto the rail base mount by pushing the second grip assembly up unto the rail base mount with the one or more guide pins aligned with the one or more guide channels followed by a rotation in the first direction and subsequent release of the second grip assembly to place the foregrip in the unlocked state;

j) repeating steps g) and h) as many times as desired to swap the grip assembly of the foregrip.

9. The method of claim 7, wherein the foregrip further comprises a thrust washer disposed between the locking spring and the plunger.

10. The method of claim 7, wherein the foregrip further comprises a bottom cap coupled to the grip body and configured to conceal the stop plate, the locking spring, and a portion of the plunger within the grip body.

11. The method of claim 7, wherein the stop plate is coupled within the grip central longitudinal bore by a retaining pin passing through an aperture of the grip body and a bore through the stop plate.

12. The method of claim 11, wherein the grip body comprises an index notch within a portion of the grip central longitudinal bore and wherein the stop plate comprises an index portion configured to mate with the index notch to align the aperture of the grip body and the bore through the stop plate.

13. A firearm comprising:

a firearm body;

one or more sectional rails coupled to the firearm body; and a foregrip coupled to one of the one or more sectional rails, the foregrip comprising:

a rail base mount, wherein the rail base mount comprises:

a head portion having a slot adapted to mate with a sectional rail;

a cylindrical portion coupled to the head portion and having one or more guide channels cut into an exterior surface of the cylindrical portion; and a rail base mount central longitudinal bore through the head portion and the cylindrical portion;

a grip assembly, wherein the grip assembly comprises:

a grip body having a grip central longitudinal bore with three or more diameters;

one or more guide pins attached to the grip body and partially protruding into the grip central longitudinal bore;

a plunger positioned substantially within the grip central longitudinal bore and captured within the grip body by an internal grip body portion and a stop plate coupled within the grip central longitudinal bore; and a locking spring disposed between the plunger and the stop plate; and a separating spring disposed within the grip body and partially disposed within a portion of the cylindrical portion of the rail base mount central longitudinal bore;

wherein the cylindrical portion of the rail base mount fits within the portion of the grip central longitudinal bore where the one or more guide pins are attached to the grip body;

wherein the one or more guide channels are configured to accommodate the one or more guide pins;

wherein the grip assembly is rotatably coupled to the rail base mount in either an unlocked foregrip state or a locked foregrip state;

wherein in the locked foregrip state, a portion of the plunger protrudes into the slot to secure the foregrip to the sectional rail; and wherein in the unlocked foregrip state; the plunger is retracted from the slot to permit the installation, repositioning, or removal of the foregrip from the sectional rail.

14. The firearm of claim 13, further comprising a thrust washer disposed between the locking spring and the plunger.

15. The foregrip of claim 13, further comprising a bottom cap coupled to the grip body and configured to conceal the stop plate, the locking spring, and a portion of the plunger within the grip body.

16. The foregrip of claim 13, wherein the stop plate is coupled within the grip central longitudinal bore by a retaining pin passing through an aperture of the grip body and a bore through the stop plate.

17. The foregrip of claim 16, wherein the grip body comprises an index notch within a portion of the grip central longitudinal bore and wherein the stop plate comprises an index portion configured to mate with the index notch to align the aperture of the grip body and the bore through the stop plate.

18. The foregrip of claim 13, wherein the grip assembly is configured to be swapped out from the rail base mount by a second grip assembly.

19. A foregrip comprising:

a rail base mount, wherein the rail base mount comprises:

a head portion having a slot adapted to mate with a sectional rail;

a cylindrical portion coupled to the head portion and having one or more guide pins attached to an exterior surface of the cylindrical portion; and a rail base mount central longitudinal bore through the head portion and the cylindrical portion;

a grip assembly, wherein the grip assembly comprises:

a grip body having a grip central longitudinal bore with three or more diameters;

one or more guide channels cut into a portion of the grip central longitudinal bore;

a plunger positioned substantially within the grip central longitudinal bore and captured within the grip body by an internal grip body portion and a stop plate coupled within the grip central longitudinal bore; and a locking spring disposed between the plunger and the stop plate; and a separating spring disposed within the grip body and partially disposed within a portion of the cylindrical portion of the rail base mount central longitudinal bore;

wherein the cylindrical portion of the rail base mount fits within the portion of the grip central longitudinal bore where the one or more guide channels are cut into the portion of the grip central longitudinal bore;

wherein the one or more guide channels are configured to accommodate the one or more guide pins;

wherein the grip assembly is rotatably coupled to the rail base mount in either an unlocked foregrip state or a locked foregrip state;

wherein in the locked foregrip state, a portion of the plunger protrudes into the slot to secure the foregrip to the sectional rail; and wherein in the unlocked foregrip state; the plunger is retracted from the slot to permit the installation, repositioning, or removal of the foregrip from the sectional rail.

20. The foregrip of claim 19, further comprising a thrust washer disposed between the locking spring and the plunger.

21. The foregrip of claim 19, further comprising a bottom cap coupled to the grip body and configured to conceal the stop plate, the locking spring, and a portion of the plunger within the grip body.

22. The foregrip of claim 19, wherein the stop plate is coupled within the grip central longitudinal bore by a retaining pin passing through an aperture of the grip body and a bore through the stop plate.

23. The foregrip of claim 22, wherein the grip body comprises an index notch within a portion of the grip central longitudinal bore and wherein the stop plate comprises an index portion configured to mate with the index notch to align the aperture of the grip body and the bore through the stop plate.

24. The foregrip of claim 19, wherein the grip assembly is configured to be swapped out from the rail base mount by a second grip assembly.

25. A method for installing, repositioning, swapping, and/or removing a foregrip on a sectional rail, the method comprising:

a) providing a foregrip comprising:

a rail base mount, wherein the rail base mount comprises:

a head portion having a slot adapted to mate with the sectional rail;

a cylindrical portion coupled to the head portion and having one or more guide pins attached to an exterior surface of the cylindrical portion; and a rail base mount central longitudinal bore through the head portion and the cylindrical portion;

a grip assembly, wherein the grip assembly comprises:

a grip body having a grip central longitudinal bore with three or more diameters;

one or more guide channels cut into a portion of the grip central longitudinal bore;

a plunger positioned substantially within the grip central longitudinal bore and captured within the grip body by an internal grip body portion and a stop plate coupled within the grip central longitudinal bore; and a locking spring disposed between the plunger and the stop plate; and a separating spring disposed within the grip body and partially disposed within a portion of the cylindrical portion of the rail base mount central longitudinal bore;

wherein the cylindrical portion of the rail base mount fits within the portion of the grip central longitudinal bore where the one or more guide channels are cut into the portion of the grip central longitudinal bore;

wherein the one or more guide channels are configured to accommodate the one or more guide pins;

wherein the grip assembly is rotatably coupled to the rail base mount in either an unlocked foregrip state or a locked foregrip state;

wherein in the locked foregrip state, a portion of the plunger protrudes into the slot to secure the foregrip to the sectional rail; and wherein in the unlocked foregrip state; the plunger is retracted from the slot to permit the installation, repositioning, or removal of the foregrip from the sectional rail;

b) with the foregrip in the unlocked foregrip state, sliding the foregrip onto the sectional rail;

c) positioning the foregrip in a desired position along the sectional rail;

d) placing the foregrip into the locked foregrip state by rotating the grip assembly in a first direction about a central longitudinal axis of the grip assembly;

e) placing the foregrip into the unlocked foregrip state by pushing the grip assembly up towards the rail base mount and then rotating the grip assembly in a second direction, opposite the first direction, about the central longitudinal axis of the grip assembly; and f) repeating steps b), c), d), and e) as many times as desired to install, reposition, or remove the foregrip from the sectional rail.

26. The method of claim 25, further comprising:

g) with the foregrip mounted to the sectional rail and in the unlocked foregrip state, swapping the grip assembly by pushing the grip assembly up towards the rail base mount followed by rotating the grip assembly in the second direction and subsequent releasing and separation of the grip assembly from the rail base mount;

h) swapping a second grip assembly onto the rail base mount by pushing the second grip assembly up unto the rail base mount with the one or more guide pins aligned with the one or more guide channels followed by a rotation in the first direction and subsequent release of the second grip assembly to place the foregrip in the unlocked state;

j) repeating steps g) and h) as many times as desired to swap the grip assembly of the foregrip.

27. The method of claim 25, wherein the foregrip further comprises a thrust washer disposed between the locking spring and the plunger.

28. The method of claim 25, wherein the foregrip further comprises a bottom cap coupled to the grip body and configured to conceal the stop plate, the locking spring, and a portion of the plunger within the grip body.

29. The method of claim 25, wherein the stop plate is coupled within the grip central longitudinal bore by a retaining pin passing through an aperture of the grip body and a bore through the stop plate.

30. The method of claim 29, wherein the grip body comprises an index notch within a portion of the grip central longitudinal bore and wherein the stop plate comprises an index portion configured to mate with the index notch to align the aperture of the grip body and the bore through the stop plate.

31. A firearm comprising:

a firearm body;

one or more sectional rails coupled to the firearm body; and a foregrip coupled to one of the one or more sectional rails, the foregrip comprising:

a rail base mount, wherein the rail base mount comprises:

a head portion having a slot adapted to mate with a sectional rail;

a cylindrical portion coupled to the head portion and having one or more guide pins attached to an exterior surface of the cylindrical portion; and a rail base mount central longitudinal bore through the head portion and the cylindrical portion;

a grip assembly, wherein the grip assembly comprises:

a grip body having a grip central longitudinal bore with three or more diameters;

one or more guide channels cut into a portion of the grip central longitudinal bore;

a plunger positioned substantially within the grip central longitudinal bore and captured within the grip body by an internal grip body portion and a stop plate coupled within the grip central longitudinal bore; and a locking spring disposed between the plunger and the stop plate; and a separating spring disposed within the grip body and partially disposed within a portion of the cylindrical portion of the rail base mount central longitudinal bore;

wherein the cylindrical portion of the rail base mount fits within the portion of the grip central longitudinal bore where the one or more guide channels are cut into the portion of the grip central longitudinal bore;

wherein the one or more guide channels are configured to accommodate the one or more guide pins;

wherein the grip assembly is rotatably coupled to the rail base mount in either an unlocked foregrip state or a locked foregrip state;

wherein in the locked foregrip state, a portion of the plunger protrudes into the slot to secure the foregrip to the sectional rail; and wherein in the unlocked foregrip state; the plunger is retracted from the slot to permit the installation, repositioning, or removal of the foregrip from the sectional rail.

32. The firearm of claim 31, further comprising a thrust washer disposed between the locking spring and the plunger.

33. The foregrip of claim 31, further comprising a bottom cap coupled to the grip body and configured to conceal the stop plate, the locking spring, and a portion of the plunger within the grip body.

34. The foregrip of claim 31, wherein the stop plate is coupled within the grip central longitudinal bore by a retaining pin passing through an aperture of the grip body and a bore through the stop plate.

35. The foregrip of claim 34, wherein the grip body comprises an index notch within a portion of the grip central longitudinal bore and wherein the stop plate comprises an index portion configured to mate with the index notch to align the aperture of the grip body and the bore through the stop plate.

36. The foregrip of claim 31, wherein the grip assembly is configured to be swapped out from the rail base mount by a second grip assembly.

* * * * *